US012595635B2

(12) United States Patent
Stofregen et al.

(10) Patent No.: US 12,595,635 B2
(45) Date of Patent: Apr. 7, 2026

(54) OFFSHORE PILE INSTALLATION METHOD AND SYSTEM

(71) Applicant: ITREC B.V., Schiedam (NL)

(72) Inventors: Matthijs Michiel Stofregen, Schiedam (NL); Terence Willem August Vehmeijer, Schiedam (NL); Marc Louis Brinkman, Schiedam (NL)

(73) Assignee: ITREC B.V., Schiedam (NL)

( * ) Notice: Subject to any disclaimer, the term of this patent is extended or adjusted under 35 U.S.C. 154(b) by 142 days.

(21) Appl. No.: 18/283,667

(22) PCT Filed: Mar. 22, 2022

(86) PCT No.: PCT/EP2022/057536
§ 371 (c)(1),
(2) Date: Sep. 22, 2023

(87) PCT Pub. No.: WO2022/200376
PCT Pub. Date: Sep. 29, 2022

(65) Prior Publication Data

US 2024/0175227 A1 May 30, 2024

(30) Foreign Application Priority Data

Mar. 23, 2021 (NL) ..... 2027817

(51) Int. Cl.
*E02D 13/04* (2006.01)
*B63B 27/16* (2006.01)
(Continued)

(52) U.S. Cl.
CPC ..... *E02D 13/04* (2013.01); *B63B 27/16* (2013.01); *B63B 35/003* (2013.01); *B63B 75/00* (2020.01);
(Continued)

(58) Field of Classification Search
CPC ..... E02D 13/04; E02D 7/00; E02D 27/425; E02D 27/525; B63B 27/10; B63B 27/16
See application file for complete search history.

(56) References Cited

U.S. PATENT DOCUMENTS

2015/0110564 A1* 4/2015 West ..... E02D 13/005 405/227
2015/0240440 A1* 8/2015 Johns ..... E02B 17/024 403/334
2017/0275845 A1* 9/2017 Belder ..... E02D 7/06

FOREIGN PATENT DOCUMENTS

CN 111441356 A 7/2020
EP 3517479 * 7/2019
(Continued)

OTHER PUBLICATIONS

International Search Report, issued in PCT/EP2022/057536, PCT/ISA/210, dated Jul. 21, 2022.
(Continued)

*Primary Examiner* — Sean D Andrish
(74) *Attorney, Agent, or Firm* — Birch, Stewart, Kolasch & Birch, LLP

(57) ABSTRACT

A method for pile installation wherein use is made of a vessel for pile installation. A pile holding system is mounted to the hull of a vessel, e.g. on deck (2) of a vessel, which pile holding system is configured to hold the pile in an upright orientation at a pile installation location at least whilst suspended from a crane by means of one or more winch driven cables, e.g. for installation of a pile adapted to support an offshore wind turbine, the pile holding system comprises a pile holding tool (40). The pile holding tool (40) further comprises a damping system including at least one damping device (45) that is mounted to the base structure (42) and is configured to, in use, engage on the pile suspended from the crane at a location that is vertically spaced
(Continued)

from the circumferential zone that is engaged by the plurality of pile engaging positioning devices (43) of the pile holding tool, and wherein the at least one damping device (45) is configured to dampen pendulum motion of the pile suspended from the crane.

14 Claims, 6 Drawing Sheets

(51) Int. Cl.

| | |
|---|---|
| ***B63B 35/00*** | (2020.01) |
| ***B63B 75/00*** | (2020.01) |
| ***E02D 7/06*** | (2006.01) |
| ***E02D 27/52*** | (2006.01) |
| *E02D 27/42* | (2006.01) |

(52) U.S. Cl.
CPC ..... *E02D 7/06* (2013.01); *E02D 27/525* (2013.01); *E02D 27/425* (2013.01)

(56) References Cited

FOREIGN PATENT DOCUMENTS

| | | | |
|---|---|---|---|
| EP | 3517479 | A1 | 7/2019 |
| KR | 10-2020-0045243 | A | 5/2020 |
| WO | WO 2016/028151 | A1 | 2/2016 |
| WO | WO 2018/117846 | A1 | 6/2018 |
| WO | WO 2019/057827 | A1 | 3/2019 |
| WO | WO 2019/125172 | A2 | 6/2019 |
| WO | WO 2019/172752 | A2 | 9/2019 |
| WO | WO 2020/171710 | A1 | 8/2020 |
| WO | WO 2020171710 | * | 8/2020 |
| WO | WO 2020/212409 | A1 | 10/2020 |

OTHER PUBLICATIONS

Search Report issued in NL priority application 2027817, dated Mar. 23, 2021.
Written Opinion of the International Searching Authority, issued in PCT/EP2022/057536, PCT/ISA/237, dated Jul. 21, 2022.

* cited by examiner

OFFSHORE PILE INSTALLATION METHOD AND SYSTEM

FIELD OF THE INVENTION

The invention pertains to a pile installation method and to a system for holding a pile to be installed in the seabed, e.g. a pile adapted to support an offshore wind turbine, e.g. a monopile. The invention further relates to a vessel including such a system.

Installation of an offshore wind turbine often involves driving a pile, e.g. a monopile, into the seabed after which the wind turbine is arranged on top of the pile. As is known in the art monopiles for wind turbines are enormous, with a length over 80 meters, and a mass of over 1000 tonnes being fairly common. Nowadays even 2000 tonnes (or more) monopiles are contemplated with a length of more than 100 meters.

In known methods, the pile to be installed is initially supported on a vessel, e.g. a jack-up vessel, in a horizontal orientation. In a typical operational sequence to install the pile, the pile is firstly upended, i.e. is pivoted in an upright orientation, using a crane having a lifting tool suspended from one or more winch driven cables. The lifting tool is engaged commonly with the upper end of the pile whilst still horizontal. Then the crane is operated to lift the upper end and thereby upend the pile. Subsequently, the pile is lowered by operation of the crane to the seabed at the pile installation location. Finally, the pile is driven into the seabed using a pile driver.

The vessel may be a jack-up vessel in order to reduce or avoid motions of the vessel induced by waves, wind and/or currents during the installation. In other designs the vessel is floating.

In order to obtain an accurate position and verticality of the pile, it is common to make use of a holding tool that is mounted to the vessel, for instance mounted to a side of the hull of the vessel or mounted to the deck. Such a tool is often referred to as a monopile gripper when configured for monopile installation.

During lowering of the pile towards the seabed, the crane is operated to lower the pile while the lifting tool retains the pile at an upper longitudinal end thereof.

The holding tool engages the pile during this process, to horizontally keep the pile in the desired place while at the same time enabling vertical movement of the pile relative to the tool to enable the lowering.

BACKGROUND OF THE INVENTION

In many prior art systems, including those disclosed in EP17826613 and EP3517479, the suspended pile is horizontally restrained or held by the holding tool at a single circumferential zone thereof prior to and during lowering, e.g. by a single ring.

When the vessel is floating, it is common for the holding tool to be configured to compensate for vessel motions in the horizontal plane, e.g. as in EP17826613 and EP3517479.

In practical methods, as soon as the seabed provides sufficient vertical support for the pile, it is decoupled from the lifting tool and a pile driving tool is installed onto the pile.

The pile is driven into the seabed until the desired depth is reached and the pile has been fixed in the seabed. After pile driving, or at an earlier stage of pile driving, the pile holder tool is decoupled from the pile.

The pile, whilst suspended from the crane, will be subject to external forces such as the wind, waves, currents, and/or crane induced forces, e.g. resulting from slewing of the crane and/or instabilities of the vessel on which the crane is mounted. Forces like these, even when fairly small compared to the enormous mass of the pile, may cause the pile to start swinging from the crane like a pendulum, possibly like a double pendulum wherein the upper end of the pile connected to the cable moves in one direction due to swing and simultaneously the lower end of the pile swings in opposite direction. The severity of this swinging may be problematic in view of the accuracy of the positioning of the pile and/or loads on the crane and/or loads on the holding tool, e.g. the positioning devices thereof, e.g. position controlled cylinders thereof.

WO2020/212409 proposes to operate two tugger lines, which are connected to the pile at a location between the pile holding tool and the hoisting cable from which the pile is suspended, in order to damp motion of the pile in two respective horizontal directions. However, the effectiveness and practicality of this solution is limited as it enables only a pulling of the pile towards the vessel, so that only a forward motion—away from the crane—of the pile can be counteracted. Furthermore, the tugger lines have an unfavorable angle for effectively pulling the pile by means of the crane, and may be inconvenient to use as they occupy, and thus render unusable, the space between the pile and the hoisting cable.

The invention proposes a method and system which is effective and practical in counteracting undue swing or pendulum motion, e.g. double pendulum motion, of the suspended pile.

SUMMARY OF THE INVENTION

The invention provides a pile holding system to be mounted to the hull of a vessel, e.g. on deck of a vessel, which pile holding system is configured to hold the pile in an upright orientation at a pile installation location at least whilst suspended from a crane by means of one or more winch driven cables, e.g. for installation of a pile adapted to support an offshore wind turbine. The invention furthermore provides a method for pile installation wherein use is made of a vessel for pile installation, e.g. for installation of a pile adapted to support an offshore wind turbine, wherein the vessel has a hull, a crane mounted on the hull, and the inventive pile holding system.

The inventive pile holding system, which is used in the inventive method, has a pile holding tool which may include

- a base structure, for example an annular base structure configured to extend about the pile,
- a support assembly that is or is to be mounted to the hull, e.g. on the deck, of the vessel, wherein the support assembly is configured to support the base structure of the pile holding tool relative to the hull,
- a plurality of pile engaging positioning devices supported by the base structure and distributed in an annular array about a center axis of the pile holding tool and configured to engage on a circumferential zone of the pile so as to hold the pile in an upright orientation at a pile installation location, e.g. each positioning device being provided with one or more pile guiding rollers.

In embodiments, the pile engaging positioning devices are position controlled, e.g. independently from one another, e.g. including position controlled hydraulic cylinders.

The pile holding tool further includes a damping system including at least one damping device that is mounted to the base structure and is configured to, in use, engage on the pile suspended from the crane at a location that is vertically spaced from the circumferential zone that is engaged by the plurality of pile engaging positioning devices, and which at least one damping device is configured to dampen pendulum motion of the pile suspended from the crane. This damping is achieved through the engagement of the pile by the at least one damping device at the mentioned location vertically spaced from the circumferential zone engaged by the pile engaging positioning devices.

The inventive method includes holding the pile suspended from the crane by means of one or more winch driven cables, wherein the plurality of pile engaging positioning devices engage on the circumferential zone of the pile that is suspended from the crane so as to hold the pile in said upright orientation at the pile installation location. The at least one damping device engages on the pile suspended from the crane at the location that is vertically spaced from the circumferential zone and dampens pendulum motion of the pile suspended from the crane.

It is thus envisaged that the damping of pendulum motion takes place whilst holding of the pile by the pile engaging and positioning devices.

In an embodiment of the method, the pile engaging positioning devices engage and hold the pile during lowering of the pile towards the seabed, and the at least one damping device dampens pendulum motion of the pile suspended from the crane during a lowering of the pile towards the seabed. The damping of pendulum motion is in particular functional during lowering of the pile towards the seabed, while being held by the pile holding system. In an embodiment of the method, the method includes lowering of the pile towards the seabed, wherein the engagement of the at least one damping device on the pile on said vertically spaced location is maintained during said lowering.

The pile engaging positioning devices may be configured to engage and hold the pile during lowering of the pile towards the seabed, and wherein the at least one damping device is configured to dampen pendulum motion of the pile suspended from the crane during a lowering of the pile towards the seabed. The configuration of the at least one damping device to dampen the pendulum motion may include a selected magnitude of the vertical spacing of the location from the circumferential zone at which it engages on the pile and/or a selected stiffness of the device between said location and the base structure of the pile holding tool.

In practice, the swinging or pendulum motions of the pile will be rather small oscillatory motions. However, the inventive damping may prove essential to avoid that the eigenfrequency is reached, which could lead to rapid increase of the motion. And, even whilst the motion is small, the enormous mass of the pile may still result in undue loads.

While lowering the pile, the zone of the pile that is engaged by the plurality of pile engaging positioning devices becomes increasingly closer to the top of the pile as the base structure does not follow the lowering of the pile.

Generally, in embodiments, the damping devices acting vertically remote on the pile from the circumferential zone that is engaged by the plurality of pile engaging positioning devices only provide for damping effects to counter (double) pendulum motion of the pile, and do not govern the verticality and position of the pile during the installation thereof. The latter is primarily done by the plurality of pile engaging positioning devices, possibly in combination with operation of the support assembly, e.g. a motion-compensating support assembly.

By providing the at least one damping device on the base structure of the pile holding tool and acting on the pile at one or more locations that are vertically spaced from the zone of the pile that is engaged by the plurality of pile engaging positioning devices, undue pendulum motion of the pile suspended from the crane can be counteracted effectively. For example, in embodiments, the damping of these motions does not require the use of tugger lines as in the prior art.

In embodiments, the at least one damping device is configured to provide damping of pendulum motion of the pile suspended from the crane in at least two opposite directions. The at least one damping device acts in two opposite horizontal directions on the pile. For example, two damping devices are configured to act in opposite horizontal directions on the pile.

For example, multiple damping devices are arranged in a common horizontal plane, e.g. the plane being located above or below the zone of the pile that is engaged by the plurality of pile engaging positioning devices, and act in opposite directions on the pile.

For example, one or more damping devices are arranged above the zone of the pile that is engaged by the plurality of pile engaging positioning devices and one or more damping devices are arranged below this zone.

In embodiments, a set of multiple damping devices is supported by the base structure and distributed in an annular array about a center axis of the pile holding tool and configured to engage on a circumferential zone of the pile that is vertically spaced from the circumferential zone that is engaged by the plurality of pile engaging positioning devices. For example, the base structure is provided with one or two annular carriers vertically above and/or below the portion of the base structure provided with the plurality of pile engaging positioning devices, wherein each annular carrier is provided with a set of multiple damping devices.

In embodiments, the plurality of pile engaging positioning devices are configured to be selectively switchable between a non-damping mode and a damping mode, e.g. the damping devices including hydraulic actuators and an associated switchable hydraulic circuit, e.g. the non-damping mode being selected for accurate positioning of the pile relative to the seabed and the damping mode being selected when the devices are being engaged with the pile, e.g. the pile being lowered or sideways moved by the crane into the pile holding tool.

In embodiments, the pile holding tool has an annular base structure portion provided with plurality of pile engaging positioning devices. The annular base structure portion may form a ring that has one or more openable yaws, as is known in the art, e.g. from WO2019125172.

The pile engaging positioning devices can each include a controllable pile engaging device movement actuator, e.g. hydraulic cylinder, e.g. one per pile engaging device, which can establish movement, e.g. independent movement, of the pile engaging positioning devices in at least the X-Y plane. This is done e.g. for positioning the pile in the X-Y plane, for example to adjust to the diameter of the pile, to locate the pile to a desired X-Y position.

As is known in the art, the pile engaging positioning devices may include one or more rollers which are adapted to engage the pile, or other surfaces suitable to engage the pile in another way such that the pile can be slid downwardly in between them while the surface remains engaged to the pile. In practical embodiments, the rollers have a horizontal roller axis. The pile engaging positioning devices are angularly distributed about the center axis, for example 4, 6 or up to 12 pile engaging positioning devices.

The pile holding tool is supported on the vessel by means of the support assembly thereof. Such support assemblies are known from e.g. the mentioned prior art. The tool is, for example, movable mounted on the deck, for enabling moving the pile holding tool relative to the vessel in the X-Y plane by means of actuators.

In embodiments, the pile holding tool includes one or more damping arms, which each extend from the base structure and engage a location of the pile that is vertically spaced from the circumferential zone.

In embodiments, each damping arm includes an engaging element which is configured to engage the pile.

The damping arms counteract opposed tilting movements of the pile which can be achieved in multiple ways. For example, two or more damping arms are provided in the same angular position relative to the center axis, and such as to extend at opposed vertical sides of the base structure, wherein at least one of the damping arms engages a further circumference of the pile below the circumferential zone, and at least another one engages a further circumference above the circumferential zone. For example, to achieve damping, two damping arms may be provided in the same angular position, or four damping arms of which two are at one angular position and two are at a diametrically opposite angular position. In another example, two or more damping arms are provided which all enclose the same further circumference either above or below the circumferential zone.

In an embodiment, two of the damping arms are configured to counteract opposed tilting movements, the damping arms extending from the base structure at opposite vertical sides of the base structure, both at the same angular position relative to the center axis at a rear or forward side of the ring. In another, or the same embodiment, the damping arms extend from the base structure both at the same vertical side of the base structure, at diametrically opposite angular positions at the rear and forward side of the ring.

For example, the damping arms are multiple damping arms which are placed around the center axis.

It is envisaged that the damping arms may be angularly movable around the center axis, e.g. by means of curved rails on the base structure, and the pile holding tool includes damping arm movement actuators for angularly moving the damping arms around the center axis. This, for example, enables to respond to changing directions of the movements inducing the tilting movements of the pile.

In an embodiment, the pile holding tool has only one damping arm for counteracting a tilting movement of the pile in its own direction. For example, this damping arm is used only for preventing forward toppling of the pile around a tilt axis parallel to the X-axis of the vessel, and is therefore provided either at a forward angular position and extends above the annular base structure for engaging a further circumference above the circumferential zone of the pile, or at a rear angular position and extends below the annular base structure for engaging a further circumference below the circumferential zone.

The damper arms may take many forms enabling its functionality, namely to provide a dampening pushing force in response to the movement of the pile against the engaging element.

In an embodiment, the damper device includes or is a resilient element, for example a block, e.g. of rubber or an elastomeric material. This resilient element may be connected to the base structure, e.g. directly fixed to the base structure. It may be oriented slanted from the base structure inwards towards the further circumference that the engaging element engages. It may be connected to a rigid element protruding from the base structure, for example a vertical beam fixed or movably connected to the base structure, and oriented slanted or horizontally from the rigid element towards the further circumference.

In an embodiment, the damper device includes or is a hydraulic or pneumatic damper, for example a hydraulic or pneumatic cylinder. This damper means may also be connected to the base structure directly or via a rigid protruding element. It may be oriented slanted from the base structure or protruding element inwards towards the further circumference. It may be combined with a hydraulic accumulator for generating pretensioning forces and/or for compensating possible volume differences in hydraulic cylinder chambers.

In an embodiment, the damper device is an active damper device, e.g. electric, hydraulic or pneumatic, for example actuatable by a control system, for example a control system also controlling the pile engaging device movement actuators and/or the actuators moving the holding tool relative to the vessel in the X-Y plane to attune the operations to each other. These active dampers may be hydraulic, pneumatic, or electric. For example, cylinders may be used, and/or winches on the base component pulling the engaging elements against the pile.

In an embodiment, the damper arm has a section connected to the base structure that is wider than the width of the engaging element, e.g. the damper arm being substantially A-shaped, wherein the engaging element is at the top end of the 'A'. This may benefit a stable and controlled operation and torsional resistance of the damper arm.

The pile engaging element of the damping arm may be or include one or more rollers which are adapted to engage the pile, or other surfaces suitable to engage the pile in another way such that the pile can be slid downwardly, i.e. in the longitudinal direction of the pile, relative to the pile holding tool, while the surface remains engaged to the pile. For example, a smooth and low-friction surface or a caterpillar-like construction. The pile engaging element may be shaped such as to complement the shape of the pile, for example be slightly concave to match the circular circumference of the pile. In an example the pile engaging element is flexible and/or compressible, so that it adapts to the shape of the pile, e.g. to different diameters of the pile. In practical embodiments, the one or more rollers on a damping arm each have a horizontal roller axis.

In an embodiment, the tool is furthermore configured for supporting the pile during upending thereof from a horizontal orientation to the upright orientation. Therein the pile holding tool is hingeably mounted on the support assembly, and is hingeable about a substantially horizontal hinge axis relative to the support assembly between a horizontal orientation, in which the pile holding tool is able to hold a pile in a substantially horizontal orientation, and a vertical orientation, in which the pile holding tool is able to hold the pile in the upright orientation. Suitable configurations for the hingeable connection are disclosed in the mentioned prior art.

In an embodiment, the damping system, e.g. the one or more damping devices thereof, includes one or more sensors for detecting tilting of the suspended pile out of the upright orientation thereof, e.g. force and/or position and/or movement sensors, wherein the one or more damper devices are controllable damper devices configured to provide a controllable damping effect, and wherein the controllable damper devices are operably connected to the one or more sensors such as to adjust the damping effect in response to the sensor measurements.

In an embodiment the damper arms include one or more sensors for detecting tilting of the held pile out of the upright orientation thereof. Such sensors may be for example force and/or movement sensors, e.g. inertial measurement sensors. In an example, such sensors are provided on the engaging elements of the damper arms, so that the force and/or movement can be measured directly at the interface of the engaging element and the pile, and thus, at the further circumference it engages.

Through these sensors, an indication for tilting of the pile towards the associated damping arm, and the extent thereof, may be detected by detecting, in case of a force sensor, the increase of the force exerted by the pile on the force sensor, as this indicates a horizontal force component towards the damper arm which is involved with tilting, or, in case of a position or movement sensor, a displacement or movement of the pile towards the sensor, as this indicates a horizontal movement component towards the damper arm which is involved with tilting. The same applies for decreases of forces or displacements or movements of the pile away from the engaging element, which is indicative of tilting of the pile away from the damper arm. In addition or alternatively, sensors indicating tilt of the pile may be provided at other parts of the damping arms.

For example, sensors may be provided on or in the damper device, e.g. strain sensors in case of a mechanical damper, or e.g. pressure or level sensors in case of a hydraulic and/or pneumatic damper. A compression or higher pressure of the damper indicates tilting of the pile towards the damping arm.

The sensors at the damping devices may be combined with sensors at the pile engaging positioning devices, e.g. at the interface with the pile at the circumferential zone. This may provide an even more accurate indication of any tilting and the extent thereof. Alternatively, the sensors may be provided elsewhere on the system, e.g. strain sensors or cameras on the annular base component or support assembly.

The sensors may be operatively coupled to controllable means and actuators of the system, and/or be connectable externally, e.g. to a dynamic positioning unit of the vessel, for controlling the movement of parts of the system and/or the vessel based on the sensor measurements, for example such as to move the further circumference and/or circumferential zone in response to the sensor measurements detecting the tilting, thereby counteracting the tilting and moving the pile back towards the upright orientation. Or, if the tilting is detected to have an extent such that it is not correctable anymore by the damper arms and/or by performing corrective movements of the vessel and/or the system and/or parts thereof, controlling these movements such as to release the pile into the sea and move the vessel away from the pile to prevent any damage to the vessel.

In an example, where the damper element includes or is an active damper means, this damper means may be controlled based on the sensor indications, e.g. automatically via a control unit. For example, a damper means of a damper arm may be operated to make the engaging element push against the further circumference it engages upon a detected tilting towards the damper arm, and with a force which corresponds to the detected extent of the tilting, so as to counteract the tilting and move the pile back to the upright orientation. Movement actuators of the pile engaging positioning devices and/or the holding tool may be operated to complement the action of the damper element, or e.g. be operated only if the action of the damper element is not sufficient to cancel out the tilting of the pile, e.g. as predicted by the control unit based on the extent of tilting indicated by the sensors, or e.g. if the sensors still indicate tilting despite the action of the damper element.

In an example, wherein the damper element is a passive damper means, for example mechanical or hydraulic or pneumatic, actuators of other parts of the system may be operated to counteract the tilting, e.g. automatically by means of a control unit, e.g. only if the control unit predicts based on the extent of tilting indicated by the sensors that the stiffness of the damper element is unable to cancel out the tilting of the pile, or e.g. if the sensors still indicate tilting despite damping by the damper element.

The invention also relates to a vessel including the system according to the invention.

DETAILED DESCRIPTION OF EMBODIMENTS

Figure 1:
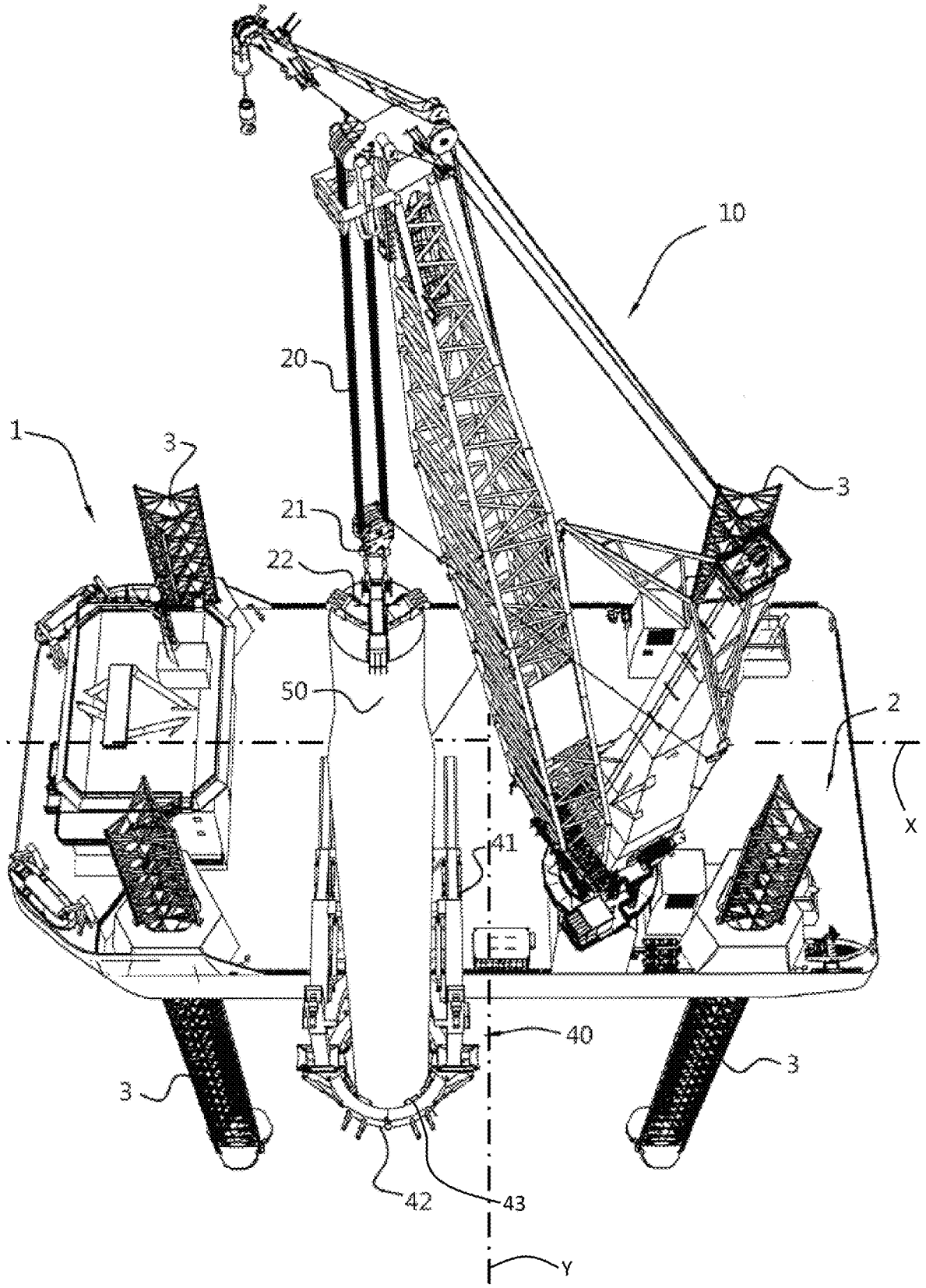
FIG. 1 shows a vessel according to the invention in a perspective view from the top, while holding a pile in an upright orientation.

FIG. 1 schematically depicts a vessel 1 while carrying out a method according to an embodiment of the invention.

Figure 2:
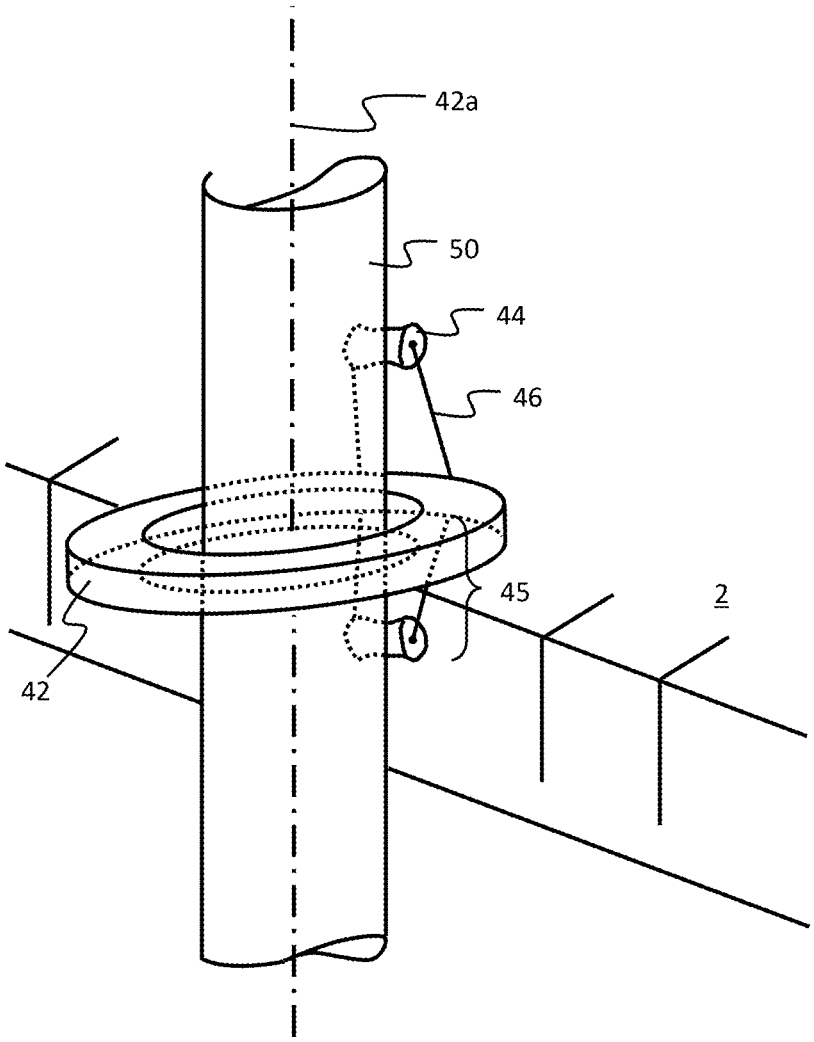
FIG. 2 shows, schematically, the arrangement of a holding tool with damper arms relative to the deck of the vessel, while holding a pile in the upright orientation.

In FIG. 2, a crane 10 is arranged on the vessel 1, more in particular on an upper deck 2 of the vessel 1. The vessel 1 is a jack-up type vessel in which legs 3 can be lowered into the water to lift the vessel 1 at least partially out of the water so that waves have a limited or minimal effect on the vessel 1.

The crane 10 as shown is a pedestal mounted crane, but it will be clear to the skilled person that the invention can also be used with other types of cranes, such as a mast crane. The crane 10 includes a hoisting system with a hoisting cable 20, a load connector 21 connected to the hoisting cable and a hoisting winch operating on the hoisting cable 20 to lower or lift the load connector 21.

The vessel further includes a pile holding tool 40 arranged on the upper deck 2. The pile holding tool 40 includes a support assembly 41 and has one annular base structure 42 supported on the vessel 1 by the support assembly 41.

The pile holding tool 40 includes, connected to the annular base structure 42, multiple pile engaging positioning devices 43 to engage with a pile 50 to hold the pile 50 and limit horizontal motion of a pile circumference or circumferential zone 51 engaged by the pile holding tool 40.

The pile engaging positioning devices 43 are distributed angularly with respect to a center axis 42*a*.

The pile engaging positioning devices 43 are provided with a plurality of rollers to engage with the pile 50 to hold the pile 50 while allowing the pile 50 to move in a direction parallel to the longitudinal axis of the pile 50, while limiting the sideways motion of the pile circumference 51. The rollers each have a horizontal roller axis.

The rollers are indicated in the schematic illustrations of the embodiments of FIGS. 3*a*, 3*b*, 4-9 of the pile holding tool 40.

Piles like the pile 50, in particular monopiles, adapted to support an offshore wind turbine, shown in FIG. 2, may be stored and/or transported on the vessel 1 or on a separate supply vessel in a horizontal orientation. Hence, in that situation, the crane 10 may be used to lift one end, i.e. an upper end of the pile 50, until the pile 50 is suspended from the hoisting cable in an upright orientation, that is, a substantially vertical orientation as shown in FIG. 2. To this end, a lifting tool 22 may be used as an interface between the pile 50 and the load connector 21.

After providing the pile 50 in the upright orientation, a lower portion or lower end of the pile 50 is provided in the annular base structure 42 of the pile holding tool 40. As such the position of the lower portion of the pile 50 is controlled by the pile holding system 40 and the position of the upper portion of the pile 50 is generally controlled using the crane and hoisting cable 20. The pile 50 is now held in an upright orientation at a pile installation location next to the vessel 1 by the pile holding tool 40.

FIG. 2 illustrates, schematically, the arrangement of the pile holding tool 40 relative to the deck, with the pile 50 held thereby in the upright orientation.

In a method for lowering the pile, the pile 50 is lowered by operating the crane paying out the hoisting cable 20 while the pile is being held by the pile holding tool 40. The pile 50 will first pass a splash zone of a body of water, which splash zone is the transition from air to water when lowering the pile 50 into the water and where the pile is subjected to waves. The pile 50 may also be subject to underwater currents, for example at lower depths, and to wind.

Figure 3A:
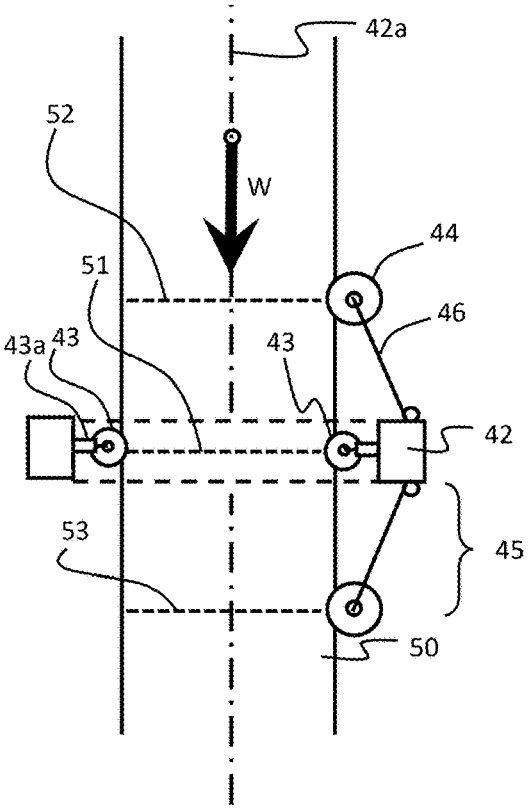
FIGS. 3*a* and 3*b* shows in a schematic side and cross-sectional view of a pile holding tool according to a possible embodiment of the invention, the pendulum motion of the pile.
Figure 3B:
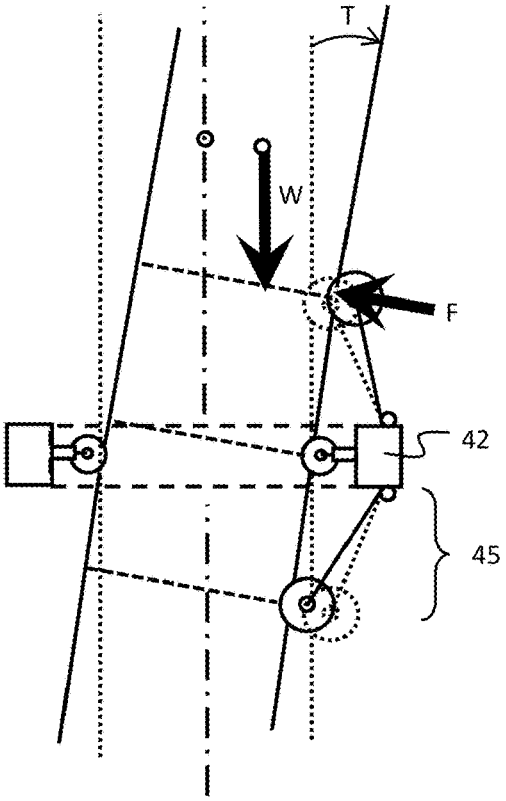

FIGS. 3*a* and 3*b* illustrate pendulum motion of the pile, on an extremely exaggerated scale, by the progression from FIG. 3*a* to FIG. 3*b*. The tilting or pendulum motion is indicated by the arrow labeled T.

To dampen out any such tilting or pendulum motion T of the suspended pile 50, a pushing or damping force F is exerted against the pile, as is indicated in FIG. 3*a* by means of an arrow.

Here, the force F is exerted on the pile by engaging element 44 of a damping device 45 having a pivotal damping arm 46.

The two damping arms 46 of the embodiment of FIGS. 3*a* and 3*b* extend upwardly and downwardly from the base structure 42, respectively.

The engaging elements 44 are in the form of a roller, that is rotatable about a horizontal axis.

The damping devices 45 each are provided with a damper element 47, which is operative between the arm 46 and the base structure 42.

In the embodiment of the pile holding tool 40 shown in FIGS. 3*a* and 3*b*, which is also shown in FIG. 2, there are two damping devices 45 with arms 46.

Each damping device having an arm 46 extends at a respective vertical side of the annular base structure 42. The damping arm 46 extending above the annular base structure 42 engages a further circumference 52 for counteracting backwards tilting around the tilt axis, that is, with the top of the pile 50 towards the vessel 1, as shown in FIG. 3*b*. The damping arm 46 extending below the annular base structure 42 engages another further circumference 53 for counteracting pendulum motion.

Both damping arms 46 are both provided at the most backward angular location at the annular base structure 42. From the figures, it may be envisaged that damping arms may also both be provided at the frontmost angular location.

Furthermore, from the Figures it may be envisaged that multiple damping devices 45, here with arms 46, may be provided around the central axis 42*a*, for example four, six, eight or ten damping arms may be provided. If, for example, in addition to the two damping arms of FIGS. 3*a* and 3*b* two similar damping arms 46 are provided extending above and below the base structure 42 at an angular location spaced 90 degrees therefrom.

Figure 4:
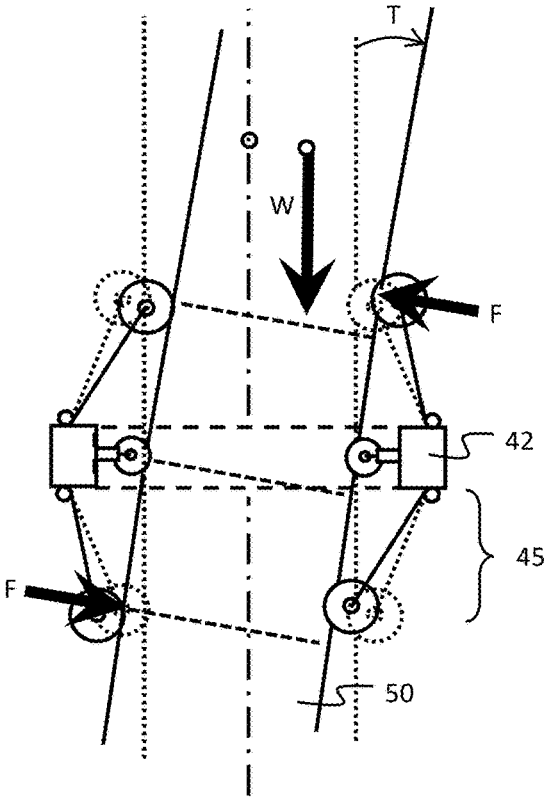
FIG. 4 shows in the same view a pile holding tool according to another possible embodiment.

An enhanced damping effect may be achieved by providing two more damping devices 45 at diametrically opposite angular locations in addition to those of FIGS. 3*a* and 3*b*, as shown in FIG. 4. The forces F exerted by damping arms 46 at diametrically and vertically opposed locations are added up to provide a force moment that counteracts the tilting motion T.

In the embodiments shown in FIGS. 3*a*, 3*b*, the pile engaging positioning devices 43 are connected to the annular base structure 42.

For each pile engaging device 43, a controllable pile engaging device movement actuator 43*a* is provided for independently moving the pile engaging element 44 with respect to the base structure 42, and therewith against the circumferential zone 51 of the pile 50.

In FIG. 1, it is visible that for the Y-direction, rails are provided via which the support assembly 41 is mounted to the deck 2 of the vessel 1. The rails may be present for the X-direction as well. By means of such rails, or equivalent means, e.g. integrated in the support assembly, the pile holding tool 40 may be moveable relative to the vessel 1. The movement actuators of the pile engaging positioning devices 43 and/or the holding tool 40 may be controlled automatically e.g. by a control unit, e.g. based on sensor measurements indicating tilting of the pile 50, as discussed herein before.

Figure 5:
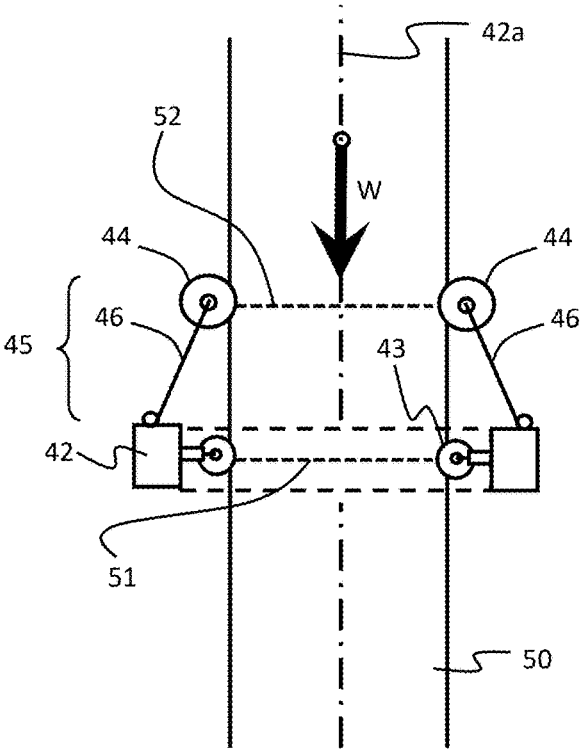
FIGS. 5-9 show in the same view a pile holding tool according to other embodiments.

In FIG. 5, an embodiment is shown wherein tilting T in opposite directions as in FIGS. 3*a* and 3*b* is counteracted by two damping devices 45, here with arms 46, which both extend at the same vertical side of the annular base structure 42, namely there above, engaging the same further circumference 52, and are provided at diametrically opposite angular locations, namely a frontmost and backmost angular location.

Figure 6:
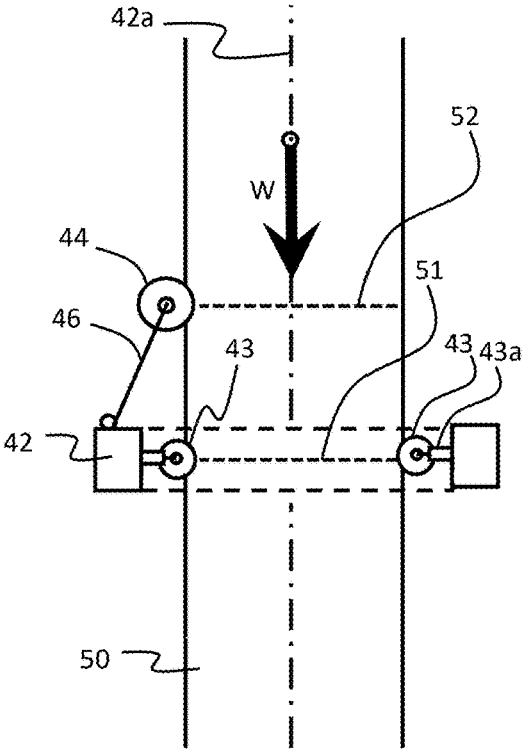

FIG. 6 shows a simple embodiment, wherein only one damping arm 46 is provided.

Figure 7:
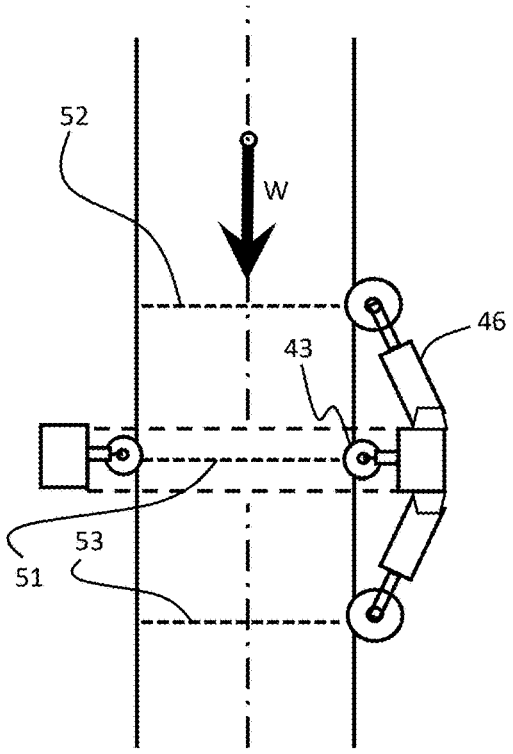

FIG. 7 shows an embodiment wherein the damper element 47 is a piston cylinder, which is fixedly mounted to the annular base structure via a fixation element. The damper arm 46 is herein formed by the piston cylinder for the largest part, and the fixation element. This piston cylinder may form an active or passive damper means—in the latter case it may be connected to an accumulator providing a gas spring. The piston cylinder may, e.g. based on sensor measurements as described herein before, be automatically controlled e.g. by a control unit for dampening the tilting of the pile.

Figure 8:
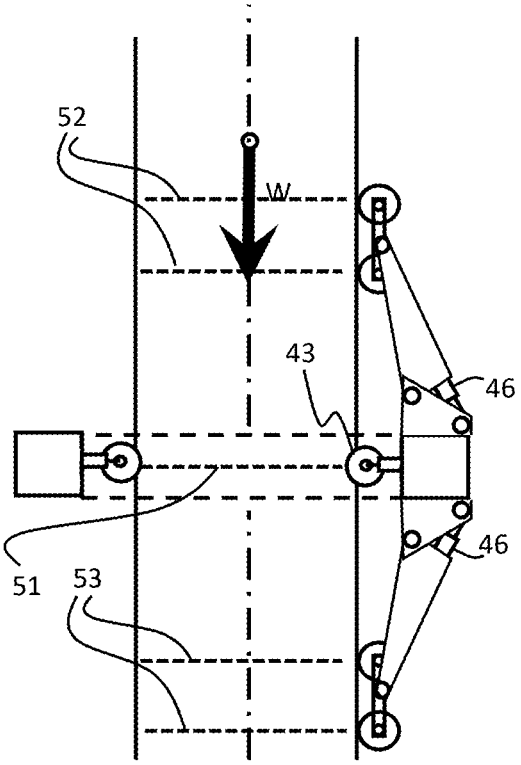

FIG. 8 shows an embodiment, wherein the damper element 47 includes a piston cylinder, and a rigid elongate element via which the force which is involved with the extension of the piston cylinder is transferred to the engaging element 44. Another embodiment is envisaged wherein the piston cylinder is replaced by one or more blocks of resilient material, e.g. rubber, or an elastomeric material.

Figure 9:
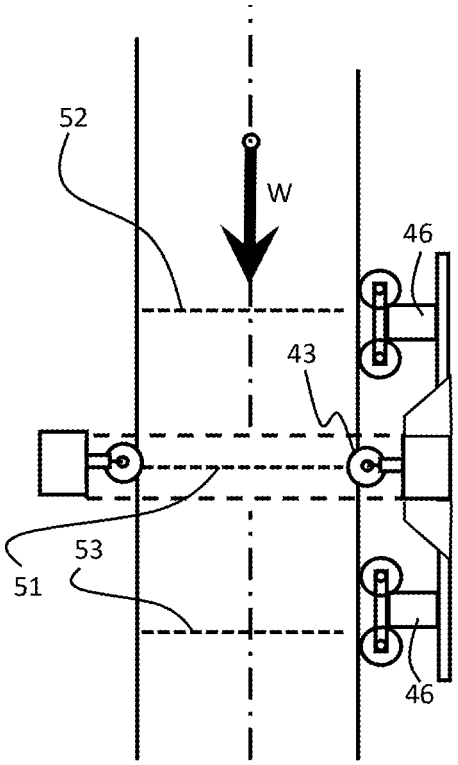

FIG. 9 shows an embodiment, wherein the damper element 47 is a block of resilient material, e.g. rubber or an elastomeric material, or a stack of these resilient blocks.

In FIGS. 8 and 9, the engaging element 44 includes two spaced parallel and interconnected rollers, so that two further circumferences 52, and two further circumferences 52 of the pile 50 are engaged thereby, and the pushing force is distributed over the rollers and circumferences 52, 53. The rollers each have a horizontal roller axis.

Figure 10:
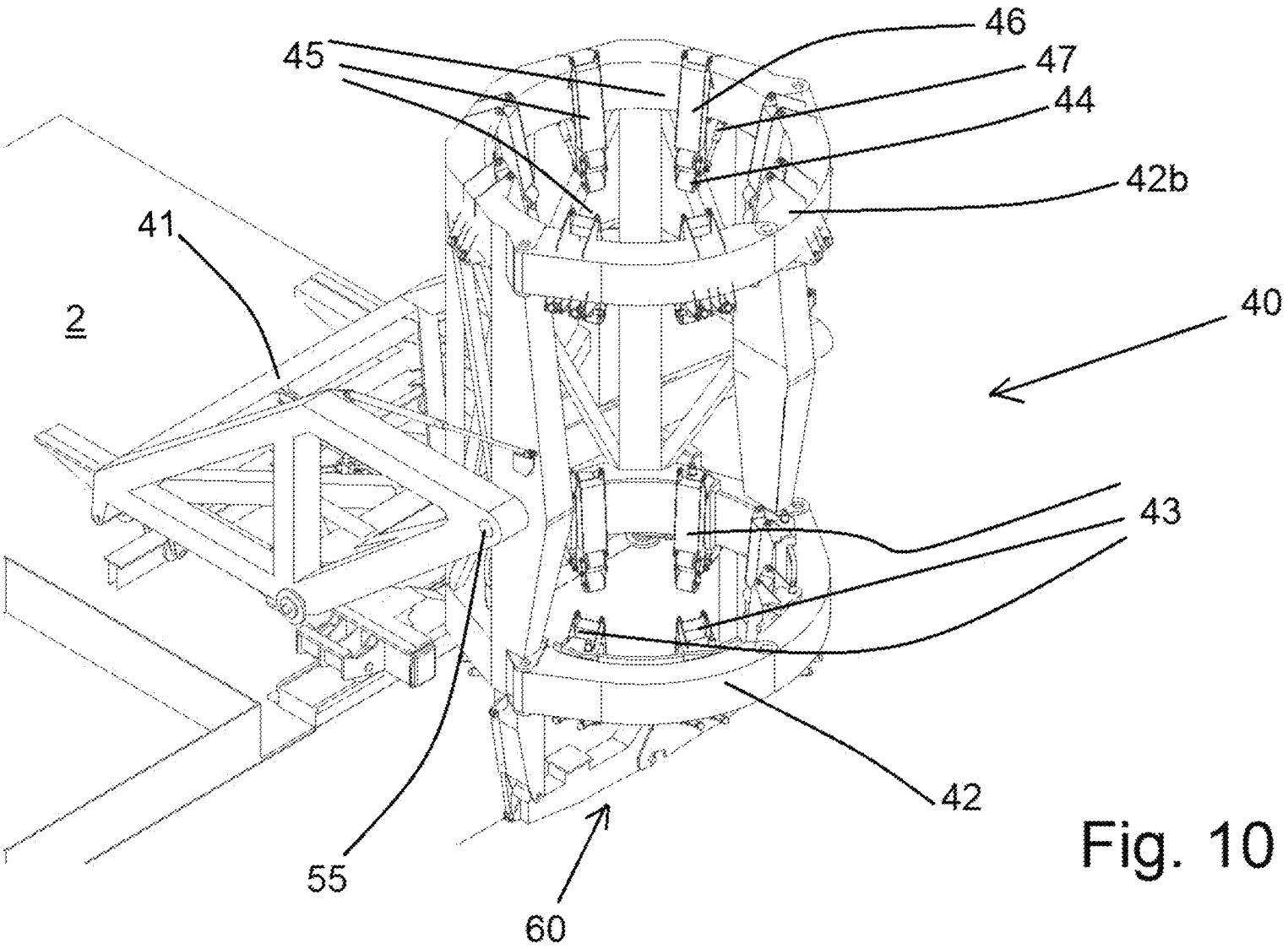
FIG. 10 shows yet another embodiment of a pile holding tool according to the invention.

FIG. 10 shows yet another embodiment of a pile holding tool according to the invention.

The tool has 40 including an annular base structure 42, a motion-compensating support assembly 41 mounted to the hull, here on the deck 2, of the vessel 1, which support assembly 41 supports the base structure 42 of the pile holding tool.

Also shown is a plurality or set of pile engaging positioning devices 43 supported by the annular base structure 42 and distributed in an annular array about a center axis 42*a* of the pile holding tool 40.

These devices 43 are configured to engage on a circumferential zone 51 of the pile so as to hold the pile in an upright orientation at a pile installation location. Each positioning device 43 is provided with one or more pile guiding rollers. The rollers have a horizontal roller axis.

The pile holding tool of FIG. 10 further includes a damping system including at least one damping device that is mounted to the base structure and is configured to, in use, engage on the pile suspended from the crane at a location that is vertically spaced from the circumferential zone that is engaged by the plurality of pile engaging positioning devices 43, and which at least one damping device is configured to dampen pendulum motion of the pile suspended from the crane.

In more detail, a set of multiple damping devices 45 is supported by the base structure 42 and distributed in an annular array about a center axis 42*a* of the pile holding tool and configured to engage on a circumferential zone of the pile that is vertically spaced from the circumferential zone that is engaged by the plurality of pile engaging positioning devices 43.

The base structure is provided with one annular carrier 42*b* vertically above the annular base structure 42 provided with the plurality of pile engaging positioning devices 43. The annular carrier 42*b* is provided with the set of multiple damping devices 45.

Both the carrier 42 band the annular base structure 42 supporting the devices 43 are provided with one or more jaws to allow opening and closing of the annulus.

Each damping device 45 includes a damping arm 46, which extends from the base structure 42, e.g. upward and/or downward, here pivotally mounted to the base structure 42*b*, and wherein each damping device includes an engaging element 44, e.g. a roller, mounted on the damping arm and configured to engage a further circumference of the pile that is vertically spaced from the circumferential zone associated with devices 43, and a damper element 47, here a hydraulic cylinder coupled with an associated hydraulic circuit, operative between the damping arm 46 and the annular carrier 42*b*.

The damping devices 45 of FIG. 10 provide damping of pendulum motion of the pile suspended from the crane in at least two opposite directions, as damping device will act in two opposite horizontal directions on the pile.

The pile holding tool 40 of FIG. 10 is furthermore configured for supporting the pile during upending thereof from a horizontal orientation to the upright orientation, wherein the base structure 42 and the carrier 42*b* are together hingeable mounted on the support assembly 41, to be hingeable about a substantially horizontal hinge axis 55, e.g. the hinge axis being parallel to a X-axis of the vessel, relative to the support assembly 41 between a horizontal orientation, in which the pile holding tool 40 is able to hold a pile in a substantially horizontal orientation, and a vertical orientation, in which the pile holding tool 40 is able to hold the pile in the upright orientation.

The pile holder tool 40 is here provided with an actuable pile foot support 60, that avoids sliding of the pile during upending, and is released or opened for lowering of the pile.

The invention claimed is:

1. A pile holding system configured to be mounted to a hull of a vessel, the pile holding system being configured to hold a pile in an upright orientation at a pile installation location at least whilst suspended from a crane by means of one or more winch driven cables, the pile holding system comprising:

a pile holding tool comprising:

a base structure;

a support assembly to be mounted to the hull of the vessel, wherein the support assembly supports the base structure of the pile holding tool;

a plurality of pile engaging positioning devices supported by the base structure and distributed in an annular array about a center axis of the pile holding tool and configured to engage on a circumferential zone of the pile so as to hold the pile in the upright orientation at the pile installation location; and a damping system including at least one damping device that is mounted to the base structure and is configured to, in use, engage on the pile suspended from the crane at a location that is vertically spaced from the circumferential zone that is engaged by the plurality of pile engaging positioning devices, the at least one damping device being configured to dampen pendulum motion of the pile suspended from the crane through said engagement on said vertically spaced location, wherein the at least one damping device each has a damping arm, the damping arm extending from the base structure, and wherein each damping device comprises:

an engaging element, mounted on the damping arm and configured to engage a further circumference of the pile that is vertically spaced from the circumferential zone, the engaging element being configured to remain engaged to the pile while the pile is slid downwardly; and a damper element operative between the engaging element and the base structure, wherein multiple damping devices are provided, arranged and configured so that two or more damping arms thereof act in two opposite horizontal directions on the pile to dampen the pendulum motion of the pile suspended from the crane in at least two opposite directions, and wherein the two or more damping arms, extend in opposite vertical directions from the base structure, so the respective engaging elements engage on the pile at opposite vertical distances from the circumferential zone.

2. The pile holding system according to claim 1, wherein the at least one damping device is configured to dampen double pendulum motion of the pile suspended from the crane through said engagement on said vertically spaced location.

3. The pile holding system according to claim 1, wherein the pile engaging positioning devices are configured to engage and hold the pile during lowering of the pile towards a seabed, and wherein the at least one damping device is configured to dampen the pendulum motion of the pile suspended from the crane during the lowering of the pile towards the seabed.

4. The pile holding system according to claim 1, wherein a configuration of the at least one damping device to dampen the pendulum motion includes at least a selected magnitude of the vertical spacing of the location from the circumferential zone at which the at least one damping device engages on the pile, and/or a selected stiffness of the at least one damping device between said location and the base structure of the pile holding tool.

5. The pile holding system according to claim 1, wherein the at least one damping device is configured to provide damping of the pendulum motion of the pile suspended from the crane in at least two opposite directions, the at least one damping device acting in two opposite horizontal directions on the pile.

6. The pile holding system according to claim 1, wherein a set of multiple damping devices is supported by the base structure and distributed in an annular array about the center axis of the pile holding tool and configured to engage on a circumferential zone of the pile that is vertically spaced from the circumferential zone that is engaged by the plurality of pile engaging positioning devices.

7. The pile holding system according to claim 1, wherein the at least one damping device comprises or is a resilient element.

8. The pile holding system according to claim 1, wherein the at least one damping device comprises or is a hydraulic or pneumatic damper.

9. The pile holding system according to claim 8, wherein the at least one damping device is or comprises a hydraulic or pneumatic piston cylinder, combined with a hydraulic accumulator for generating pretensioning forces and/or for compensating possible volume differences in hydraulic cylinder chambers of the at least one damping device.

10. The pile holding system according to claim 1, wherein the at least one damping device has a lower section connected to the base structure that is annularly wider than a width of an engaging element engaging the pile.

11. The pile holding system according to claim 1, wherein the pile holding tool is configured for supporting the pile during upending thereof from a horizontal orientation to the upright orientation, and wherein the base structure is hingeable mounted on the support assembly, and is hingeable about a substantially horizontal hinge axis relative to the support assembly between a horizontal orientation, in which the pile holding tool is able to hold the pile in a substantially horizontal orientation, and a vertical orientation, in which the pile holding tool is able to hold the pile in the upright orientation.

12. The pile holding system according to claim 1, wherein the pile engaging positioning devices comprise controllable pile engaging device movement actuators.

13. The pile holding system according to claim 1, wherein the damping system comprises one or more sensors for detecting tilting of the suspended pile out of the upright orientation thereof, and wherein the at least one damping device are controllable damper devices configured to provide a controllable damping effect, and wherein the controllable damper devices are operably connected to the one or more sensors such as to adjust the damping effect in response to measurements by the one or more sensors.

14. A vessel for pile installation comprising:

a hull;

a crane mounted on the hull; and a pile holding system according to claim 1 mounted to the hull, the pile holding system being configured to hold a pile in an upright orientation at a pile installation location at least whilst suspended from the crane by means of one or more winch driven cables.

* * * * *